United States Patent [19]

Muller

[11] Patent Number: 4,462,359

[45] Date of Patent: Jul. 31, 1984

[54] PULSED BLEED AIR THROTTLE POSITION CONTROLLER

[75] Inventor: J. Joseph Muller, St. Louis, Mo.

[73] Assignee: ACF Industries, Inc., New York, N.Y.

[21] Appl. No.: 405,742

[22] Filed: Aug. 6, 1982

[51] Int. Cl.[3] ..... F02M 3/00

[52] U.S. Cl. ..... 123/339; 123/360; 91/52; 91/459; 251/141

[58] Field of Search ..... 123/339, 360; 91/52, 91/459; 251/141, 129

[56] References Cited

U.S. PATENT DOCUMENTS

| | | | |
|---|---|---|---|
| 4,095,567 | 6/1978 | Chenet | 123/339 |
| 4,168,680 | 9/1979 | Kawai et al. | 123/339 |
| 4,274,376 | 6/1981 | Tsiang et al. | 123/360 |
| 4,370,960 | 2/1983 | Otsuka | 123/339 |
| 4,425,767 | 1/1984 | Barbier | 251/129 |

FOREIGN PATENT DOCUMENTS

| | | | |
|---|---|---|---|
| 1775713 | 8/1971 | Fed. Rep. of Germany | 251/129 |
| 2072753 | 10/1981 | United Kingdom | 123/339 |

*Primary Examiner*—Andrew M. Dolinar

*Attorney, Agent, or Firm*—J. Joseph Muller

[57] ABSTRACT

Apparatus for controlling the idle speed of an internal combustion engine. A contact arm contacts a throttle lever to limit movement of the lever in one direction and to move the lever in the opposite direction so to control the position of a carburetor throttle valve. A vacuum operated unit maintains the contact arm at one position and moves it from one position to another. The vacuum pressure at which the vacuum unit operates is controlled by an electrically operated variable position solenoid which controls flow of bleed air to the vacuum unit. When the solenoid is maintained at one position, the contact arm is maintained at a particular position by the vacuum unit. The contact arm is moved to a new position when a change in the solenoid position changes the vacuum pressure in the vacuum unit to a different level.

8 Claims, 3 Drawing Figures

PULSED BLEED AIR THROTTLE POSITION CONTROLLER

BACKGROUND OF THE INVENTION

This invention relates to apparatus for controlling the idle speed of an internal combustion engine and more particularly to a vacuum operated unit for obtaining such control.

It is advantageous to control the position at which a carburetor throttle valve is allowed to close when an engine on which the carburetor is mounted is idling. This is because engine idle speed is thus controlled which helps improve both fuel economy and reduce exhaust emissions. Various devices are available for controlling engine idle, among these being the devices shown in U.S. Pat. Nos. 4,067,306 and 4,315,174 both of which are assigned to the same assignee as the present application. The devices shown in these patents as well as the subject of the present application are used in conjunction with an electronic feedback system to achieve idle speed control. In addition to the advantages noted above, use of these devices effectively tamperproofs the idle speed system of the carburetor to prevent adjustment of engine idle speed by modifying the carburetor after it leaves the manufacturers.

SUMMARY OF THE INVENTION

Among the several objects of the present invention may be noted the provision of a pulsed bleed air throttle position controller for automatically controlling the idle speed of an internal combustion engine; the provision of such a controller utilizing vacuum and air to control engine idle speed; the provision of such a controller which interfaces with an automobile's electronic feedback system to control engine idle speed; the provision of such apparatus using a variable position solenoid; and, the provision of such a controller which eliminates the need for a carburetor fast idle cam and associated linkages while still providing a constant idle speed throughout engine warmup.

Briefly, apparatus of the present invention is for use with a carburetor mounted on an internal combustion engine to control the idle speed of the engine. The carburetor has a throttle valve mounted on a rotatable shaft to one end of which is secured a lever for rotating the shaft and moving the throttle valve. The apparatus comprises a contact arm contacting the lever to limit movement of the lever in one direction and to move the lever in the opposite direction thereby to control the position of the throttle valve when the engine is idling. A vacuum unit operates under vacuum pressure to maintain the contact arm at one position and to move the contact arm from one position to another. The vacuum unit includes a chamber exposed at vacuum. An electrically operated unit includes a variable position solenoid for bleeding air to the chamber to modulate the vacuum pressure therein. The vacuum unit maintains the contact arm in one position when vacuum pressure is maintained at one level by the solenoid and moves the contact arm to a new position when the solenoid position changes the amount of air bled to the vacuum unit. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
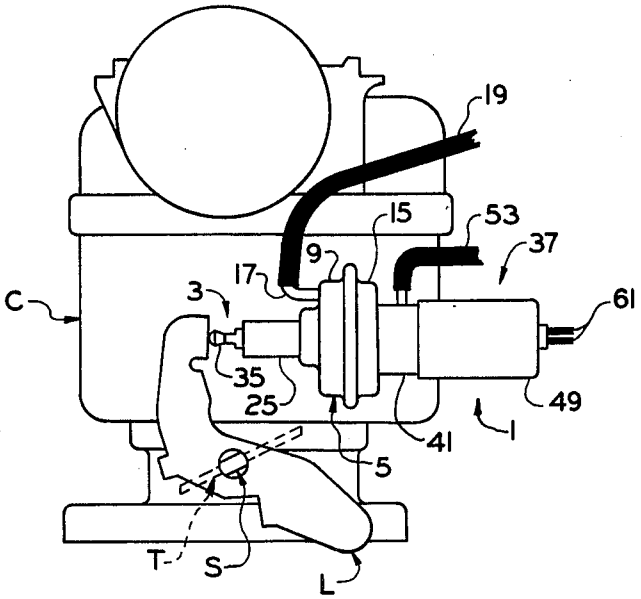
FIG. 1 is a side elevational view of a carburetor and the apparatus of the present invention for controlling engine idle speed.

Referring to the drawings, apparatus 1 of the present invention is for use with a carburetor C mounted on an internal combustion engine (not shown) to control the idle speed of the engine. Carburetor C has a throttle valve T mounted on a rotatable shaft S. A throttle lever L is secured to one end of shaft S. As is well known in the art, movement of throttle lever L produces rotation of shaft S to move throttle valve T. The throttle valve is opened when the engine is accelerated and substantially closed when the engine is at idle.

Apparatus or engine idle speed controller 1 comprises a means 3 contacting lever L to limit movement of the lever in one direction and to move the lever in the opposite direction. By controlling the position at which throttle valve T is maintained while the engine is at idle, the idle speed of the engine can be controlled at a desired revolutions per minute (rpm).

Figure 2:
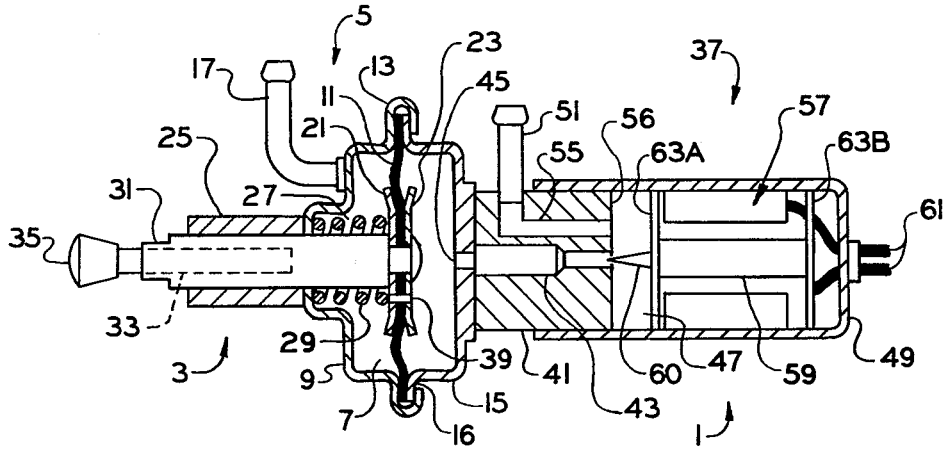
FIGS. 2 and 3 are side elevational views, in section, of the apparatus of the present invention illustrating two different operational positions of the apparatus.
Figure 3:
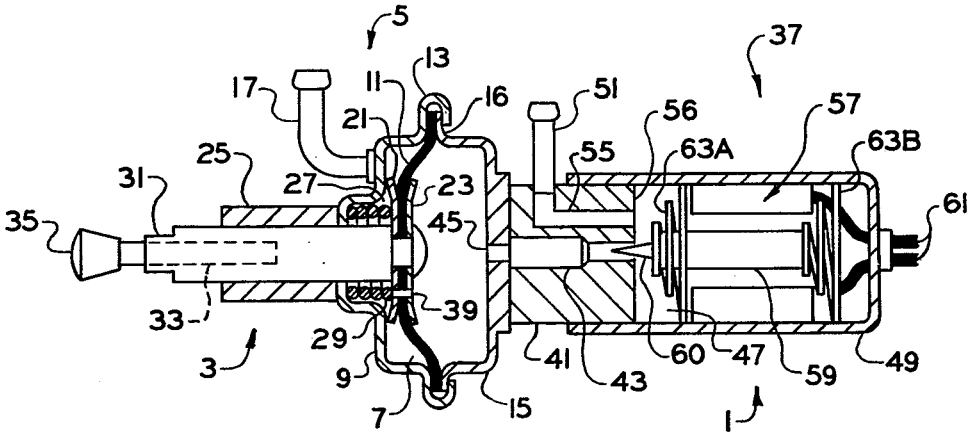

Apparatus 1 further includes a vacuum means 5 operating under vacuum pressure for maintaining the contact means in one position and for moving the contact means from one position to another. Vacuum means 5 comprises means defining a vacuum chamber 7 communicating with a vacuum source (not shown) to create a vacuum pressure in the chamber. Vacuum means 5 includes a cup-shaped housing 9 open at one end. A flexible diaphragm 11 covers the open end of the housing and the space enclosed by the side walls of the housing and the diaphragm constitutes vacuum chamber 7. As shown in FIGS. 2 and 3, housing 9 has an outwardly turned circumferential rim 13 against which the outer margin of diaphragm 11 abuts. A second cup-shaped housing unit 15 also has an outwardly turned circumferential rim 16 against which the other side of the outer margin of diaphragm 11 abuts. Rim 13 of housing 9 is spun or crimped over the rim 16 of housing 15 to secure diaphragm 11 in place. Housing 9 has an opening in its base in which is fitted an inlet tube 17. A coupling 19 (see FIG. 1) is connected to tube 17 and also to a vacuum source (not shown). Vacuum chamber 7 is exposed to vacuum communicated to vacuum means 5 by the tubing. Diaphragm 11 is sandwiched between a pair of backing plates 21 and 23 respectively. The central base portion of housing 9 is outwardly turned to form an elongate, cylindrical guide section 25. A shoulder 27 is formed at the inner end of guide 25 and a bias spring 29 seats against shoulder 27 and bears against diaphragm backing plate 21. Bias spring 29 urges diaphragm 11 to the right as shown in FIGS. 2 and 3 while the vacuum pressure in chamber 7 draws the diaphragm to the left as shown in the figures. Consequently, the position of diaphragm 11 at any one time is determined by the force of spring 29 and the vacuum pressure present within chamber 7.

Contact means 3 includes an extendible and retractable contact arm 31 sized to fit in guide 25. Contact arm 31 has a hollow threaded bore 33 extending inwardly from its outer end. A contact member 35 is threadably received in bore 33 and the outer end of contact member 35 contacts throttle level L. The inner end of contact arm 31 is attached to diaphragm 11 in any convenient manner for the contact arm to move with the diaphragm as it flexes to the left or to the right.

Apparatus 1 next includes electrically operated means 37 for modulating the vacuum pressure at which vacuum unit 5 operates. This permits vacuum unit 5 to maintain contact arm 31 in one position when the vacuum pressure is maintained at one pressure level and for the vacuum unit to move the contact arm to a new position when means 37 changes the vacuum pressure to a different pressure level. As shown in FIGS. 2 and 3, diaphragm 11 has an air bleed 39 therethrough and means 37 includes means defining an air passage by which air is introduced into vacuum chamber 7 through bleed 39. For this purpose, means 37 includes an air flow block 41 having a central bore 43. Housing 15 has an air flow restriction 45 communicating with one end of bore 43 and the opposite end of bore 43 is of a reduced diameter to also create an air flow restriction. The right end of bore 43 opens into an air chamber 47 which is defined by a cylindrical housing 49. An air tube 51 enters the side of air flow block 41 and is connected to an air source (not shown) via a flexible tubing 53 (see FIG. 1). An air passage 55 formed in block 41 allows air entering tube 51 to flow into chamber 47. Both the outlet of passage 55 and the inlet of bore 43 are in a common wall 56 of block 41. Consequently, air entering block 41 through inlet tube 51 is communicated to vacuum chamber 7 via passage 55, air chamber 47, flow passage 43, restriction 45, and air bleed 39 in diaphragm 11.

To modulate the vacuum pressure in chamber 7, electrically operated means 37 includes a variable position solenoid 57. Solenoid 57 has a movable armature 59 with a tapered end 60 that projects or extends into the inlet of bore 43. The solenoid is energized via an electrical signal routed to apparatus 1 by a pair of electrical leads 61. Armature 59 has a pair of scroll springs, 63A and 63B at its respective ends. The design of these springs is similar to that shown in U.S. Pat. No. 4,105,726 which issued Aug. 8, 1978 and is assigned to the same assignee as the present application. The function of these scroll springs is to provide for linear movement of armature 59 as the signal supplied to the windings of solenoid 57 changes. The position of the armature at any one time and hence the position of tapered end 60 relative to the inlet of passage 43 is determined by the magnetic force acting on the armature due to the electrical signal supplied to the armature windings and the biasing force exerted on the armature by the scroll springs. The position of the tapered end 60 relative to the inlet of bore 43 determines the amount of bleed air flowing to vacuum chamber 7.

Solenoid 57 is supplied an electrical signal from a controller (not shown) whose function is to monitor various engine operating parameters and supply, for example, a variable amplitude signal to the solenoid. When a low amplitude signal is supplied to the solenoid, armature 59 is moved to the position shown in FIG. 2. In this position, tapered end 60 is substantially withdrawn from the bore 43 inlet and a relatively large amount of bleed air flows through the previously described flow path to vacuum chamber 7. As a result, spring 29 acts to move the diaphragm 11 assembly to the right as shown in the FIGURE. If a higher amplitude signal is supplied to the solenoid, armature 59 moves to the position shown in FIG. 3 with tapered end 60 of the armature being inserted into the bore 43 inlet. Now, a relatively smaller amount of bleed air flows to vacuum chamber 7 and the vacuum pressure in the chamber overcomes the bias force of spring 29 to move diaphragm assembly to the left as shown in the FIGURE. It will be understood that the position shown in FIGS. 2 and 3 are exemplary only and that the apparatus can assume a range of positions depending upon the amplitude of the signal supplied to the solenoid. Further, the solenoid will maintain the pressure level in chamber 7 at one level for so long as the amplitude of the signal supplied to it is unchanged thus to maintain contact arm 31 in the same position. When, however, the amplitude of the signal changes, the position of the armature changes. This, in turn, changes the amount of bleed air flowing to chamber 7 and results in contact arm 31 being moved thus to change engine idle speed.

In view of the above, it will be seen that the several objects of the invention are achieved and other advantageous results obtained.

As various changes could be made in the above constructions without departing from the scope of the invention, it is intended that all matter contained in the above description and shown in the accompanying drawings shall be interpreted as illustrative and not in a limiting sense.

What is claimed is:

1. Apparatus for controlling the position of a carburetor throttle valve and thereby the idle speed of an engine on which the carburetor is mounted comprising:

means contacting a lever attached to one end of a throttle shaft on which the throttle valve is mounted to limit movement of the lever in one direction and to move the lever in the opposite direction;

vacuum means operating under vacuum pressure for maintaining the contact means in one position and for moving the contact means from one position to another, the vacuum means including a chamber exposed to vacuum; and, electrically operated means including a variable position solenoid for bleeding air to the chamber to modulate the vacuum pressure therein, the electrically operated means also including an air-flow passage communicating with the chamber and means controlling flow of air through the passage to the chamber thereby to maintain the vacuum in the chamber at one level and to change it from one level to another, and the electrically operated means further including an air flow block having a central bore therein which defines said air flow passage and an inlet end thereof and with flow restrictions at each end of the central bore, and a passage for introducing outside air into the apparatus, the outlet of the outside air passage and said inlet end of the central bore being in a common plane defined by a cross section of a wall of the air flow block, and wherein said means controlling flow of air variably controls the cross sectional area of said inlet of end of the central bore.

2. The apparatus of claim 1 wherein the vacuum means included a housing open at one end and a flexible diaphragm covering the open end of the housing, the housing and the diaphragm defining the vacuum chamber and the diaphragm having a bleed hole therethrough by which air is bled into the chamber.

3. The apparatus of claim 2 wherein the contacting means comprises an extendible and retractible contact arm one end of which contacts the throttle lever and the other end of which is attached to the diaphragm, movement of the diaphragm in response to vacuum pressure changes moving the contact arm from one position to another.

4. The apparatus of claim 3 wherein the variable position solenoid has a movable armature with a tapered end projecting into one end of the air flow passage whereby the position of the armature at any one time controls the amount of bleed air flowing through the air flow passage at that time.

5. Apparatus for controlling the position of a carburetor throttle valve and thereby the idle speed of an engine on which the carburetor is mounted comprising:

means contacting a lever attached to one end of a throttle shaft on which the throttle valve is mounted for limiting the position to which the throttle valve is allowed to close and for moving the throttle lever to vary the position of the throttle valve at engine idle to adjust the idle speed of the engine;

vacuum means operating under vacuum pressure for maintaining the contact means in one position and for moving the contact means from one position to another, the vacuum means including a chamber exposed to vacuum; and, electrically operated means for bleeding air to the chamber to vary the vacuum pressure therein, the electrically operated means including an air-flow passage communicating with the chamber and a variable position solenoid, the variable position solenoid having a movable armature with a tapered end projecting into an inlet end of the passage to control the amount of air flowing therethrough and spring means at each respective end of the armature for providing linear movement of the armature whereby the armature may assume one of a range of positions to control the amount of air flowing through the passage, and the electrical means further including an air flow block having a central bore therein which defines said air flow passage and said inlet end and with flow restrictions at each end of the central bore, and a passage for introducing outside air into the apparatus, the outlet of the outside air passage and said inlet end of the central bore being in a common plane defined by a cross section of a wall of the air flow block.

6. The apparatus of claim 5 wherein each spring means comprises a scroll spring.

7. The apparatus of claim 6 wherein the vacuum means includes a housing opened at one end and a flexible diaphragm covering the open end of the housing, the housing and diaphragm defining the vacuum chamber and the diaphragm having a bleed hole therethrough by which air is bleed into the chamber.

8. The apparatus of claim 7 wherein the contacting means comprises an extendible and retractible contact arm one end of which contacts the throttle lever and the other end of which is attached to the diaphragm, movement of the diaphragm in response to vacuum pressure changes moving the contact arm from one position to another.

* * * * *